United States Patent [19]

Bone

[11] 3,980,379

[45] Sept. 14, 1976

[54] ELECTRICAL CONNECTOR

[75] Inventor: Clive Bone, London, England

[73] Assignee: The Post Office, London, England

[22] Filed: June 30, 1975

[21] Appl. No.: 591,933

Related U.S. Application Data

[62] Division of Ser. No. 388,909, Aug. 16, 1973, Pat. No. 3,914,004.

[30] Foreign Application Priority Data

Aug. 23, 1972 United Kingdom ..... 39283/72

[52] U.S. Cl. ..... 339/98

[51] Int. Cl.[2] ..... H01R 9/08

[58] Field of Search ..... 339/97–99

[56] References Cited

UNITED STATES PATENTS

| | | | |
|---|---|---|---|
| 2,866,170 | 12/1958 | Baldridge | 339/99 R |
| 2,908,884 | 10/1959 | Wirsching | 339/99 R |
| 3,355,699 | 11/1967 | Oshva | 339/99 R |
| 3,668,301 | 6/1972 | Faulconer | 339/97 R |

*Primary Examiner*—Joseph H. McGlynn

[57] ABSTRACT

An electrical connector for making connection with a wire comprising an electrically conductive core and an electrically insulative covering by stripping the insulative covering from the core over a longitudinally extending portion of the wire and making electrical contact between a length of the bared core and an electrically conductive element; said connector comprising a support member having a mouth therein, said mouth having at least one stripping edge, on a side wall of the mouth; a tongue for moving into the mouth; and a guide means for the wire; the arrangement being such that, in use, the wire is located across the mouth with the aid of the guide means and as the tongue is moved into the mouth the insulative covering is stripped from the core by the stripping edge and the wire is wedged in the mouth between the tongue and the side wall of the mouth with a bared length extending within the mouth.

4 Claims, 17 Drawing Figures

ELECTRICAL CONNECTOR

This is a division of application Ser. No. 388,909, filed Aug. 16, 1973, now U.S. Pat. No. 3,914,004.

This invention relates to an electrical connector for making an electrical connection with a wire comprising an electrically conductive core and an electrically insulated covering by stripping the insulative covering from the core over a longitudinally extending portion of the wire and making electrical contact between a length of the bared core and an electrically conductive element such as the core of another wire.

It is known from British patent specification No. 1,179,715 to connect two insulated wires by means of a metal, trough-shaped member comprising a base formed with slots having upturned edges and a tongue associated with each slot. In use, two insulated wires to be connected are laid side-by-side in the trough-shaped member and the tongues are bent down into the slots to trap the wires therein with the upturned edges penetrating the insulation of the wires to effect electrical connection between the cores thereof.

It is well known, of course, that both the current-carrying capacity and the reliability of connection of an electrical connector depends upon the area of contact between the connected elements. With some previously-known connectors, including the afore described example, the area of contact is relatively low. It is an object of the invention to provide a connector in which the electrically conductive core of an insulated wire is bared over a longitudinally extending portion and electrical contact is made over a length of the bared core so that the area of contact is relatively large. This is done by providing a tongue which is moveable to trap an insulated wire in a mouth, the insulative covering of the wire being penetrated, and is then moveable further to bare a substantial area of the core of the wire.

According to the invention there is provided an electrical connector for making an electrical connection with a wire comprising an electrically conductive core and an electrically insulative covering by stripping the insulative covering from the core over a longitudinally extending portion of the wire and making electrical contact between a length of a bared core and an electrically conductive element; said connector comprising a support member having a mouth therein, said mouth having at least one stripping edge, on a side wall of the mouth; a tongue for moving into the mouth and guide means for the wire; the arrangement being such that, in use, said wire is located across the mouth with the aid of the guide means and as the tongue is moved into the mouth the insulative covering is stripped from the core by the stripping edge and the wire is wedged in the mouth between the tongue and a side wall of the mouth with the bared length extending within the mouth.

The support member may include a number of further mouths and a corresponding number of further tongues associated therewith and co-operatively moveable therein. With this arrangement, said further co-operating mouths and tongues may be variously dimensioned and arranged to shear the wire at one point and to grip the wire at another point, said points being preferably on opposite sides of the stripping edge.

The preferred form of this arrangement is one in which a first of said further mouths includes a shear edge and the tongue associated with the first mouth includes a shear edge co-operative with the shear edge of the first mouth, the co-operative shear edges lying on opposite sides of and adjacent a shear plane and being arranged, upon movement of the tongue in the first mouth to move, relatively, parallel to said shear plane and shear the wire in the shear plane and a second of said further mouths includes an anchor edge and the tongue associated with the second mouth includes an anchor edge co-operative with the anchor edge of the second mouth, the co-operative anchor edges lying on opposite sides of and spaced from an interjacent plane and being arranged, upon movement of the second tongue in the second mouth, to move, relatively, parallel to the interjacent plane and deform the wire therebetween to anchor the wire.

The support member may be formed of electrically conductive material and said conductive element may comprise part of the connector.

Any of the tongues may be joined to the support member by a link which is deformable by the movement of the tongue. Further, the connector may comprise clench means including a projection on the tongue adapted to move with the tongue towards the support member to clench the wire thereagainst.

The stripping edge may be indented, either to assist in guiding the wire into the mouth or to aid penetration of the insulative covering.

An electrical connector according to the invention may be adapted to make electrical contact between the core of one wire and the core of a further wire, in which case the connector may include a further stripping edge on said side wall, the stripping edges projecting from said side wall within a channel therein which is convergent in the direction of movement of the tongue into the mouth; the arrangement being such that, in use, said further wire is laid across the mouth, generally parallel to and spaced apart from said one wire and as the tongue is moved into the mouth insulative covering is stripped from the electrically conductive core of the further wire by the further stripping edge to bare a length of the core of the further wire and bared lengths of the wires are guided together by the convergent channel to force them into mutual electrical contact. With such a connector, which is preferably formed of electrically insulative material such as synthetic plastics, the stripping edges may be formed on opposite sides of a tooth projecting from the base of the channel and formed with faces extending from the stripping edges generally parallel to the sides of the channel, which are convergent.

The invention will now be described by way of example only with reference to the accompanying drawings in which.

Figure 1:
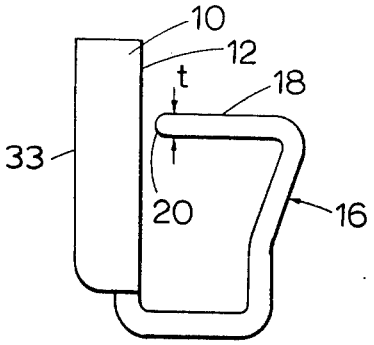
FIG. 1 is an enlarged side elevation of a connector according to the invention.
Figure 2:
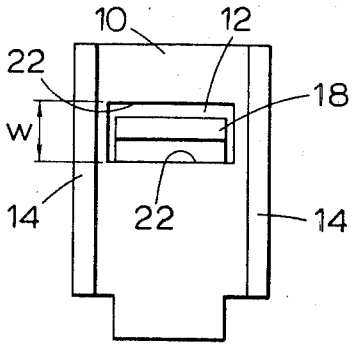
FIG. 2 is a front elevation of the connector shown in FIG. 1.
Figure 3:
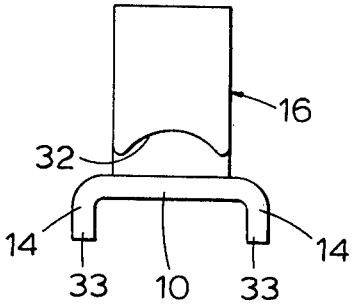
FIG. 3 is a plan view corresponding to FIGS. 1 and 2.

Referring firstly to FIGS. 1 to 3, the connector shown therein comprises a rectangular web 10 formed with a rectangular mouth 12. Flanges 14 extend along opposed edges of the web 10 to increase its stiffness and provide means for locating the connector in a matrix as will be described hereinafter.

Extending from an edge of the web 10 is a tongue indicated at 16 which is formed to return over part of the web 10 and to be directed at its free end 18 towards the mouth 12. The end 18 of the tongue 16 is rounded as indicated at 20. The mouth 12 has sharp stripping edges along two opposed side walls 22.

Figure 4:
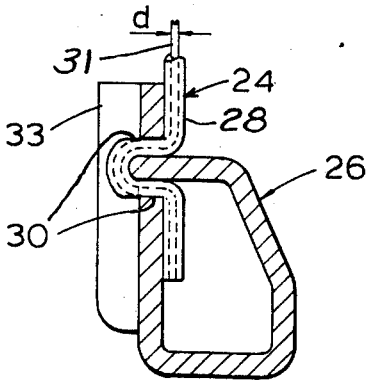
FIG. 4 is a sectional view showing an electrical connection made using the connector shown in FIGS. 1 to 3.

The connector is formed from a malleable steel having a rust-protective coating. The web 10 comprises a support member for a wire to be connected and it will be seen that the tongue 16 is joined thereto by way of a deformable link indicated at 23 in FIG. 4. Thus, by deformation of the link 23, the tongue 16 may be moved, relative to the mouth 12, to cause its end 18 to enter the mouth 12. In use, an insulated wire indicated at 24 in FIG. 4 and having an electrically conductive core and an electrically insulative covering, is located across the mouth 12 and the tongue 16 is moved into the mouth by deformation of the link as indicated at 26 in FIG. 4, with the end 18 of the tongue 16 inserted in the mouth 12. The mouth 12 and the tongue 16 are so dimensioned and arranged that when the tongue 16 enters the mouth 12 in this way it causes the insulative covering 28 on the wire 24 to be stripped from the wire over longitudinally extending portions indicated at 30 to cause the core 31 of the wire 24 to make electrical contact with the connector over a length thereof. A length of the bared core 31 thereby extends within the mouth 12 and the wire 24 is wedged in the mouth 12 between the tongue 16 and each of the side walls 22. This wedging action results both from the selected dimensions of the mouth 12 and the tongue 16, the width $w$ of the mouth 12 being approximately equal to the thickness $t$ of the tongue 16 plus twice the diameter $d$ of the core 31, and the resilient reaction of the deformed wire against the side walls 22 of the mouth 12.

The tongue 16 is formed with a recess 32 at its end 18. The recess 32 provides guide means to assist in locating the wire 24 across the mouth 12 and also assists in guiding the wire 24 into the mouth 12, the wire 24 acting on the tongue 16 to center its end 18 in the mouth 12 as it is inserted therein.

The tongue 16 may be moved into the mouth by the use of pliers, not shown. One jaw of the pliers may be held against the rear edges 33 of the flanges 14 to provide a stop for the tongue 16 and prevent its insertion so far into the mouth 12 as to cause mechanical failure of the wire 24.

It will be seen from an examination of FIGS. 1 to 4, that the operative movement of the tongue 16 is in two stages: a first stage in which the wire is trapped in the mouth and the insulative covering 28 is pierced by the stripping edges of the connector and a second stage in which the tongue 16 moves further into the mouth 12 and draws the wire 24 with it against the stripping edges to bare the core 31 over longitudinally extending portions.

Figure 5:
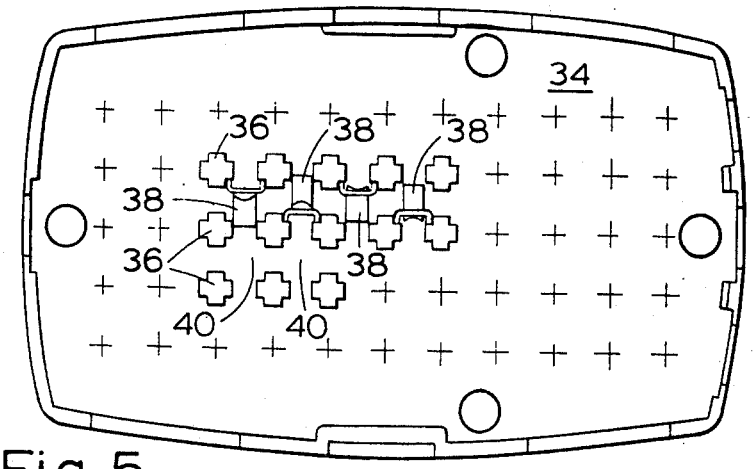
FIG. 5 is a plan view of a terminal block including means for arranging, in a matrix, a number of connectors of the type shown in FIGS. 1 to 4.

Referring now to FIG. 5, this shows a terminal block formed from a synthetic plastics material and intended for use with a number of connectors of the type shown in FIGS. 1 to 4. The block comprises a base 34 and a number of upstanding, integrally moulded posts such as is indicated at 36. Each of the posts 36 has a cruciform cross-section. The posts define interstitial locations for the connectors. A number of connectors are indicated at 38 and empty interstitial locations are shown at 40. It will be seen from FIG. 5 that the connectors may be conveniently arranged head-to-tail to form a compact matrix. Each connector may provide connection with more than one wire and the matrix can provide a number of connections in a small space. In use, a number of connectors may be seated each at the top of its interstitial location. To make a connection with one of the connectors a wire to be connected is located across its mouth as hereinbefore described and it is then pushed down between the adjacent posts which engage the tongue and move it into the mouth to make the connection as hereinbefore described.

It will be appreciated that the connector described with reference to FIGS. 1 to 5 is particularly useful in that an electrical connection can be made without the use of any special tool. Further, the connector may be used repeatedly, since if it is necessary to change a connection already made the tongue can be levered away from the mouth, for instance by means of a screwdriver inserted between the tongue and the web, and a new connection made.

Figure 6:
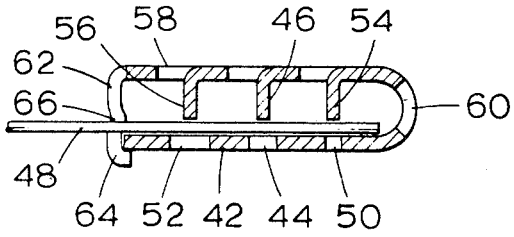
FIG. 6 shows another form of connector according to the invention.

Referring now to FIG. 6, this shows in cross-section another form of connector according to the invention. The connector of FIG. 6 is formed from malleable metal and comprises a support member indicated at 42, a mouth indicated at 44 and formed with sharp stripping edges and a tongue 46 moveable into the mouth 44 to effect a connection between a wire 48 and the connector in the manner hereinbefore described with reference to FIGS. 1 to 4. The connector also comprises two further mouths, a first of which is indicated at 50 and a second of which is indicated at 52 and first and second tongues 54 and 56 respectively co-operative with the first and second mouths. The tongues 46, 54 and 56 are substantially similar and approximately equal in thickness. However, the first mouth 50 is relatively narrow compared with the mouth 44 and the second mouth 52 is relatively wide. In fact, the first mouth 50 is only just wide enough to accommodate the first tongue 54, so that when the first tongue 54 is moved into the first mouth 50 it will shear the wire 48 and permit the free end portion thereof to be removed.

The wire 48 is sheared by co-operating shear edges of the first tongue 54 and the first mouth 50. When, on the other hand, the second tongue 56 is moved into the second mouth 52 it merely deforms the wire 48 by the relative movement of co-operating anchor edges on the tongue 56 and mouth 52 and thereby anchors the wire 48 against its being pulled out of the connector.

The tongues 46, 54 and 56 are mutually integral, being formed by deformation of a strip indicated at 58 and are connected to the support member 42 by means of a deformable link 60 which permits the tongues to be moved simultaneously into their associated mouths. At the end of the connector remote from the link 60, the strip 58 is bifurcated and bent to provide guide means for the wire 48 as indicated at 62. A lip 64 on the guide means 62 engages the support member 42 to prevent the tongues 46, 54 and 56 from being withdrawn excessively far from their associated mouths and a convexity 66 in the guide means 62 provides a detent for the tongues in their operative position.

Figure 7:
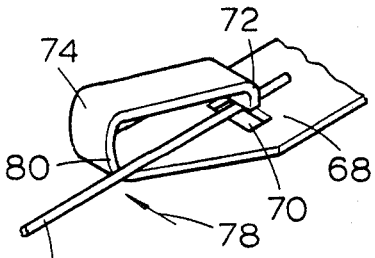
FIG. 7 shows another form of connector according to the invention.

FIG. 7 is an isometric view of another form of connector according to the invention. The connector comprises a support member 68 formed with a mouth 70 and a tongue 72 joined to the support member 68 by a deformable link 74. The connector is especially suited for the automatic making of connections, wire indicated at 76 being fed in the direction of arrow 78 until it abuts a side 80 of the link 74, which provides guide means for the wire and locates it across the mouth 70 for a connection to be made. The tongue 72 is then moved into the mouth 70 by some means not shown, which may be automatic.

Figure 8:
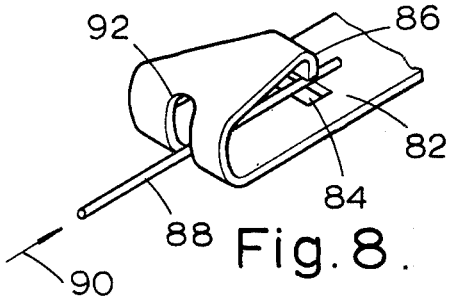
FIG. 8 shows another form of connector according to the invention.

The connector of FIG. 8 is generally similar to that of FIG. 7 and comprises a support member indicated at 82, a mouth 84 and a tongue 86. In this case, however, wire 88 is fed in the direction of arrow 90 through guide means formed by a bifurcated, deformable link 92 joining the tongue 86 to the support member 82. The wire is fed either for a predetermined distrance or until it engages a stop, not shown, and connection is then made by moving the tongue 86 into the mouth 84.

The connectors of FIGS. 7 and 8 may be formed from a malleable metal such as mild steel or brass.

Figure 9:
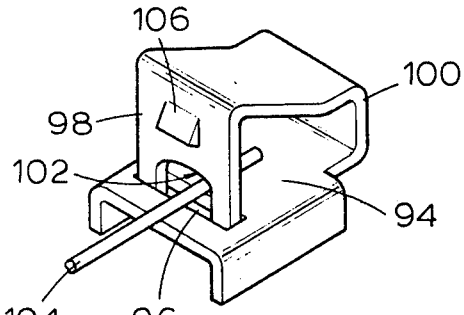
FIG. 9 shows another form of connector according to the invention.

FIG. 9 shows a connector which is generally similar to that hereinbefore described with reference to FIGS. 1 to 5 and comprises a support member in the form of a flanged web 94, a mouth 96 and a tongue 98 joined to the web 94 by a deformable link 100. In this case, however, the connector is formed with the end of the tongue 98, which is markedly recessed as indicated at 102, already received in the mouth 96, so that the tongue 98 may be moved thereinto more conveniently. The recessed portion 102 of the tongue 98 provides guide means for the wire 104. The tongue 98 is also formed with a projection 106 which, when the tongue 98 is moved into the mouth 96 to effect a connection with the wire 104 in the manner to be understood from the foregoing description, engages the wire 104 and clenches it against the support member embodied in the web 94. Thus the projection 106 and the web 94 provide clench means against pull-out of the wire 104 from the connector.

Figure 10:
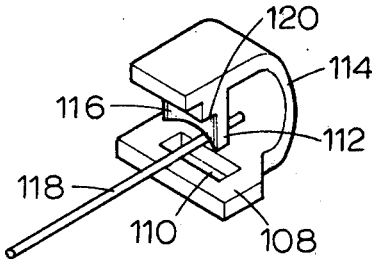
FIG. 10 shows another form of connector according to the invention.

In each of the aforedescribed connectors, the mouth in which insulative covering is stripped from the wire and electrical connection is effected has two stripping edges on two opposed side walls. The connector on FIG. 10, however, has only one stripping edge. Referring to FIG. 10, the connector comprises a support member 108, a mouth 110 and a tongue 112 connected to the support member 108 by a deformable link 114. The tongue 112 is curved in cross-section, having a concave face 116 on one side and an obverse face, not visible in FIG. 10, which is convex. The arrangement is such that when the tongue 112 enters the mouth 110 to effect a connection, the convex, obverse face of the tongue 112 provides a shear edge co-operating with the edge of the adjacent side wall of the mouth 110 to shear wire 118 and permit the free end thereof to be removed. The concave face 116 is so arranged that it co-operates with the edge of the side wall adjacent thereto to strip insulative covering from the wire 118 and effect electrical connection with the core thereof in the manner hereinbefore described. A projection 120 on the tongue 112 provides, with the support member 108, clench means to prevent a tug on the connected wire from causing its inadvertent removal.

Figure 11:
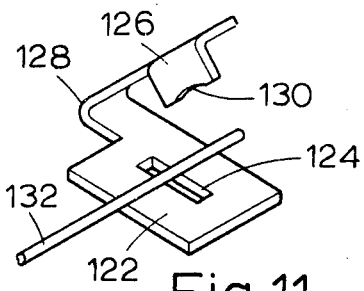
FIG. 11 shows another form of connector according to the invention.

The connector of FIG. 11 comprises a support member 122, a mouth 124 and a tongue 126. This connector, unlike the aforedescribed examples, has the tongue 126 thereof joined to the support member 122 by a deformable link 128 disposed to one end rather than a side of the mouth 124. A recess 130 in the end of the tongue 126 permits the wire 132 to be located across the mouth 124 in the correct position for a connection to be made and the tongue 126 can then be moved, upon deformation of the link 128 into the mouth 124 to make a required connection, the recess 130 guiding the wire 132 generally into the centre of the mouth 124.

Figure 12:
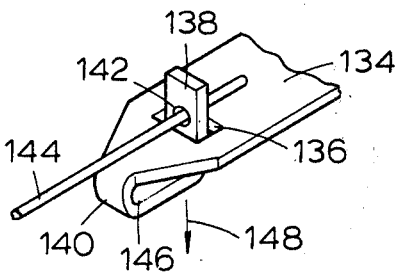
FIG. 12 shows another form of connector according to the invention.

With all the aforedescribed connectors, connection can be made without the use of special tools by, for instance, moving the tongue into the mouth by gripping the connector between the jaws of a pair of pliers. The connector of FIG. 12 permits a connection to be made conveniently by the use of a simple screwdriver. Referring to FIG. 12, this shows a connector formed of malleable metal and comprising a support member 134, a mouth 136 and a tongue 138. The tongue 138 is connected to the support member 134 by a deformable link 140 so formed that the tongue, in its inoperative state, is already inserted in the mouth 136. The tongue 138 is formed with an aperture 142 providing guide means for a wire 144 to be connected. Connection is made by inserting the blade of a screwdriver, not shown, into the space 146 beneath the support member 134 and adjacent the link 140 and twisting the screwdriver to draw the projecting portion of the tongue 138 down into the mouth, in the direction of arrow 148, carrying with it the wire 144 located in the aperture 142 to strip insulative covering from the wire 144 by means of sharp edges on the side walls of the mouth 136 and make electrical contact between one or both side walls and the bared portion of the core of the wire 144.

Figure 13:
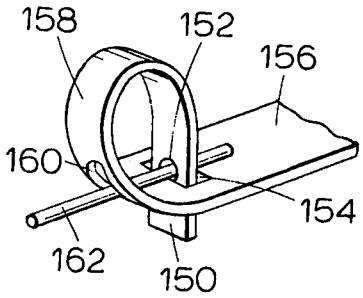
FIG. 13 shows another form of connector according to the invention.

The connector of FIG. 13 is generally similar to that of FIG. 12, having a tongue 150 formed with an aperture 152 and arranged, when inoperative to be already received within a mouth 154 in a support member 156. Relative to the connector of FIG. 12, however, the aperture 152 lies on the opposite side of the support member 156. The tongue 150 is joined to the support member 156 by a deformable link 158 which is slotted as indicated at 160 to permit a wire 162 to be entered in the aperture 152. To make a connection, the free end of the tongue 150 is gripped and pulled generally away from the support member 156 so that the portion of the wire 162 received in the aperture 152 is drawn into the mouth 154, sharp edges on the side walls of the mouth 154 baring the core of the wire 162 to enable electrical contact to be made therewith. The connector is made from malleable metal and, in use, electrical contact is made between the bared core and one or each side wall of the mouth 154. The tongue 152 can conveniently be moved into the mouth 154 by gripping its free end between the jaws of a pair of pliers and then twisting the pliers.

All the aforedescribed connectors are made of electrically conductive material so that electrical contact can be made between the bared core of a wire and the connector itself. In contrast, the connector illustrated in FIGS. 14 to 17 is made of electrically insulative material but is so arranged as to permit two insulated wires to be connected together.

Figure 14:
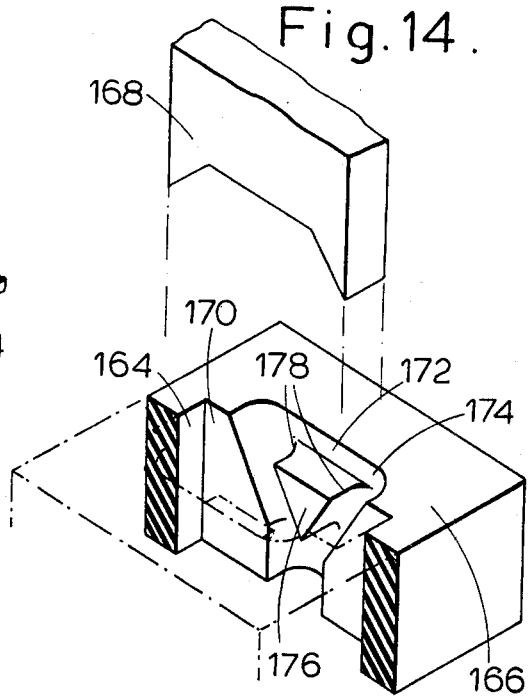
FIG. 14 shows a form of connector according to the invention adapted to connect together two insulated wires.

Referring now to FIG. 14, this shows a diagramatic view of the connector, partly cut away to show the configuration of the mouth indicated at 164. The mouth 164 is formed in a support member indicated at 166 and the connector also includes a tongue indicated at 168. One side wall 170 of the mouth 164 is formed with a convergent channel indicated at 172 and projecting from the base 174 of the channel 172 is a tooth 176 formed with two sharp stripping edges 178.

Figure 15:
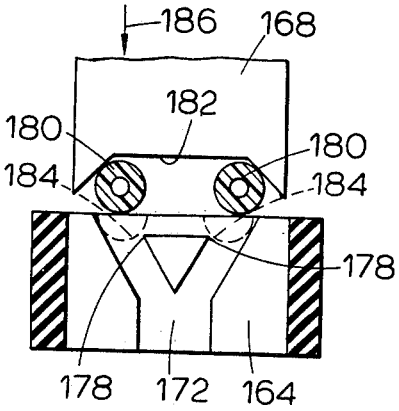
FIG. 15 shows, in cross-section, the connector of FIG. 14 immediately prior to making a connection therewith.
Figure 16:
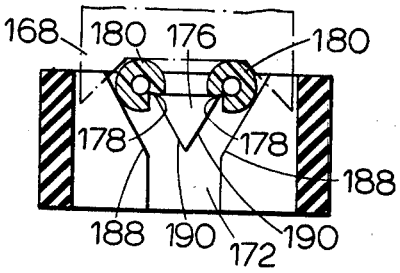
FIG. 16 is a view generally similar to FIG. 15 but showing the connector at a stage where insulative covering is being stripped from the wires to be connected.
Figure 17:
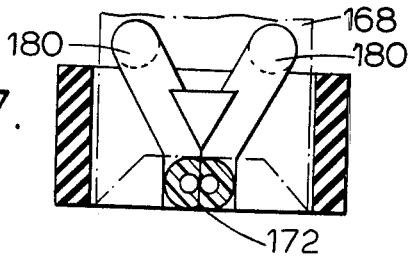
FIG. 17 is a view generally similar to FIGS. 15 and 16 and showing two wires connected together.

The use of the connector is illustrated in FIGS. 15 to 17. Two wires 180 are located across the mouth 164 with the aid of a recess 182 in the end of the tongue 168, as shown in FIG. 15. If required, the connector may be formed with depressions indicated in broken lines at 184 to provide further guide means for the wires.

With the wires located the tongue 168 is moved into the mouth, in the direction of arrow 186 so that the wires are engaged with the sharp edges 178 of the tooth 176 as shown in FIG. 15. The sharp edges 178 pierce insulative covering on the wires 180 and cause their cores to be bared over longitudinally extending portions. The channel 172 has sides 188 which are convergent in the direction of arrow 186 and the tooth 176 has faces 190 extending from the sharp edges 178 generally parallel to the sides 188. Upon further movement of the tongue 168 in the direction of arrow 186, the sides 188 and the faces 190 act upon the wires 180 and guide them together. Movement of the tongue 168 continues until the wires 180 are held in the connector with the bared core portions thereof located in the narrowest part of the channel 172 and held thereby in mutual electrical contact, as shown in FIG. 17.

Inessential details have been omitted from FIGS. 14 to 17 but it will be appreciated that, if required, the tongue 168 may be joined to the support member 166 by way of a deformable link or by means of posts upstanding adjacent the ends of the mouth 164 and shearably attached to the tongue 168.

The foregoing description is not intended to limit the invention and embodiments other than those described will be apparent to those skilled in the art. It will be noted, however, that all the embodiments described utilise the same principle in making an electrical connection with an insulated wire, namely providing a co-operative mouth and tongue arrangement in which a stripping edge is effective upon movement of the tongue into the mouth to strip insulative covering from the conductive core of the wire over a substantial area. Furthermore, all the described embodiments of the invention are conveniently re-usable.

What I claim is:

1. An electrical connector comprising a support member with a mouth formed therein, said mouth having at least one side wall provided with a pair of channels arranged to converge into a single channel, a member projecting from said sidewall intermediate said pair of channels and having a first and a second stripping edge, a tongue member slidably positioned within said mouth of said support member, a plurality of insulated covered wire cores positioned across said mouth and beneath said tongue member with said tongue member engaging said wire cores upon being moved into said mouth, with one of said wire cores engaging said first stripping edge and a second wire core engaging said second stripping edge to strip the insulative covering from said cores with the bared lengths of said cores being guided by the converging channels into the single channel upon the movement of the tongue in the said mouth whereby said cores are forced into mutual electrical contact.

2. An electrical connector as claimed in claim 1 wherein said first and second stripping edges are formed on opposite sides of a tooth projecting from the side wall between said channels and formed with faces extending from the stripping edges generally parallel to sides of the channels which are convergent.

3. An electrical connector as set forth in claim 1 wherein said connector is formed from insulative material.

4. An electrical connector as claimed in claim 3 wherein said insulative material is a synthetic plastics.

* * * * *